US012416404B2

(12) United States Patent
Cadima

(10) Patent No.: US 12,416,404 B2
(45) Date of Patent: Sep. 16, 2025

(54) GAS BURNER ASSEMBLY AND COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 323 days.

(21) Appl. No.: 18/183,116

(22) Filed: Mar. 13, 2023

(65) Prior Publication Data

US 2024/0310037 A1 Sep. 19, 2024

(51) Int. Cl.

| | |
|---|---|
| ***F23D 14/06*** | (2006.01) |
| ***F23D 14/08*** | (2006.01) |
| ***F23D 14/20*** | (2006.01) |
| ***F23D 14/64*** | (2006.01) |
| ***F23D 14/84*** | (2006.01) |
| ***F24C 3/08*** | (2006.01) |

(52) U.S. Cl.
CPC ..... *F23D 14/06* (2013.01)

(58) Field of Classification Search
CPC ..... F23D 14/06; F23D 14/08; F23D 14/20; F23D 14/065; F23D 14/084; F23D 14/64; F24C 3/067; F24C 3/085; F24C 3/08
See application file for complete search history.

(56) References Cited

U.S. PATENT DOCUMENTS

| | | | | |
|---|---|---|---|---|
| 4,968,246 | A | 11/1990 | Sasada et al. | |
| 6,325,619 | B2 * | 12/2001 | Dane | F24C 3/085 431/278 |
| 9,416,963 | B2 | 8/2016 | Armanni | |
| 10,125,997 | B2 * | 11/2018 | Park | F23D 14/84 |
| 10,731,851 | B2 | 8/2020 | Angulo | |
| 2013/0233296 | A1 | 9/2013 | Cadima | |
| 2014/0190467 | A1 | 7/2014 | Cadima | |
| 2017/0023245 | A1 * | 1/2017 | Araujo Monsalvo | F23D 14/06 |
| 2019/0017710 | A1 * | 1/2019 | Cadima | F24C 3/124 |

FOREIGN PATENT DOCUMENTS

| | | | |
|---|---|---|---|
| CN | 1317527 | C | 5/2007 |
| KR | 101598625 | B1 | 2/2016 |

* cited by examiner

*Primary Examiner* — Deming Wan
(74) *Attorney, Agent, or Firm* — Dority & Manning, P.A.

(57) ABSTRACT

A cooktop appliance and a gas burner assembly are provided. The gas burner assembly includes an annular burner body forming a central combustion zone and a plurality of flame ports. An annular burner head is placeable onto the burner body to form a top wall of an annular mixing chamber upstream from the plurality of flame ports. A mixing tube extends along an axial direction and includes an inlet passage extending along the axial direction in fluid communication with the mixing chamber. The mixing tube is configured to provide a flow of gaseous fuel to the mixing chamber. The burner head includes a tab extending along the axial direction into the mixing chamber. The tab is radially co-positioned to at least one flame port and the inlet passage.

16 Claims, 11 Drawing Sheets

GAS BURNER ASSEMBLY AND COOKTOP APPLIANCE

FIELD

The present subject matter relates generally to cooktop appliances with gas burner assemblies, such as gas range appliances or gas stove appliances.

BACKGROUND

Certain cooktop appliances include gas burners for heating cooking utensils on the cooktop appliances. Gas burners that fire inwards, typically with a swirling flame pattern, offer better efficiency than traditional outward firing gas burners. Inward fired burners typically include round, concentric inner and outer walls that are typically larger in diameter than those of outward fired burners. The difference in diameter can have various drawbacks. For instance, large widths forming thick structures between inner and outer diameters are typically aesthetically undesired, therefore appliance designers are limited in a width between inner and outer diameters. Additionally, an inner diameter is generally limited based on burner power and appliance interface. Furthermore, circular inner diameters at inward fired burners may further include partition walls at gas plenums for improving flame and heat distribution. Still further, inward firing gas burners having off-center gas feeding structures may allow for having a cleanable surface at an open center.

One or more of the aforementioned limitations typically cause undesired trade-offs between aesthetic appearance, flame and heat uniformity, and improved efficiency.

Accordingly, it would be beneficial and advantageous to provide a cooktop appliance and burner assembly that overcomes the trade-offs between aesthetic appearance, flame and heat uniformity, and improved efficiency.

BRIEF DESCRIPTION

Aspects and advantages of the invention will be set forth in part in the following description, or may be obvious from the description, or may be learned through practice of the invention.

An aspect of the present disclosure is directed to a cooktop appliance including a top panel and a gas burner assembly positioned at the top panel. The gas burner assembly includes an annular burner body positioned at a top surface of the top panel, the annular burner body forming a central combustion zone, a plurality of flame ports at the central combustion zone, and an annular mixing chamber upstream from the plurality of flame ports to permit a fuel-air mixture to flow into the central combustion zone through the plurality of flame ports, the annular burner body being open at the central combustion zone such that a circumferentially bounded portion of the top panel is vertically exposed through the annular burner body at the central combustion zone, the gas burner assembly including and annular burner head forming a top wall of the mixing chamber, the burner head including a tab extending along an axial direction into the mixing chamber, the tab radially co-positioned to at least one flame port and an inlet passage forming a fluid communication from a mixing tube to the mixing chamber, wherein the mixing tube and inlet passage are configured to receive a flow of gaseous fuel and provide the gaseous fuel to the mixing chamber.

Another aspect of the present disclosure is directed to a gas burner assembly for a cooktop appliance, the gas burner assembly including an annular burner body forming a central combustion zone, wherein the burner body forms a plurality of flame ports at the central combustion zone, the burner body being open at the central combustion zone; an annular burner head placeable onto the burner body to form a top wall of an annular mixing chamber upstream from the plurality of flame ports, a mixing tube extending along an axial direction, the mixing tube including an inlet passage extending along the axial direction in fluid communication with the mixing chamber, the mixing tube configured to provide a flow of gaseous fuel to the mixing chamber, wherein the burner head includes a tab extending along the axial direction into the mixing chamber, the tab radially co-positioned to at least one flame port and the inlet passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
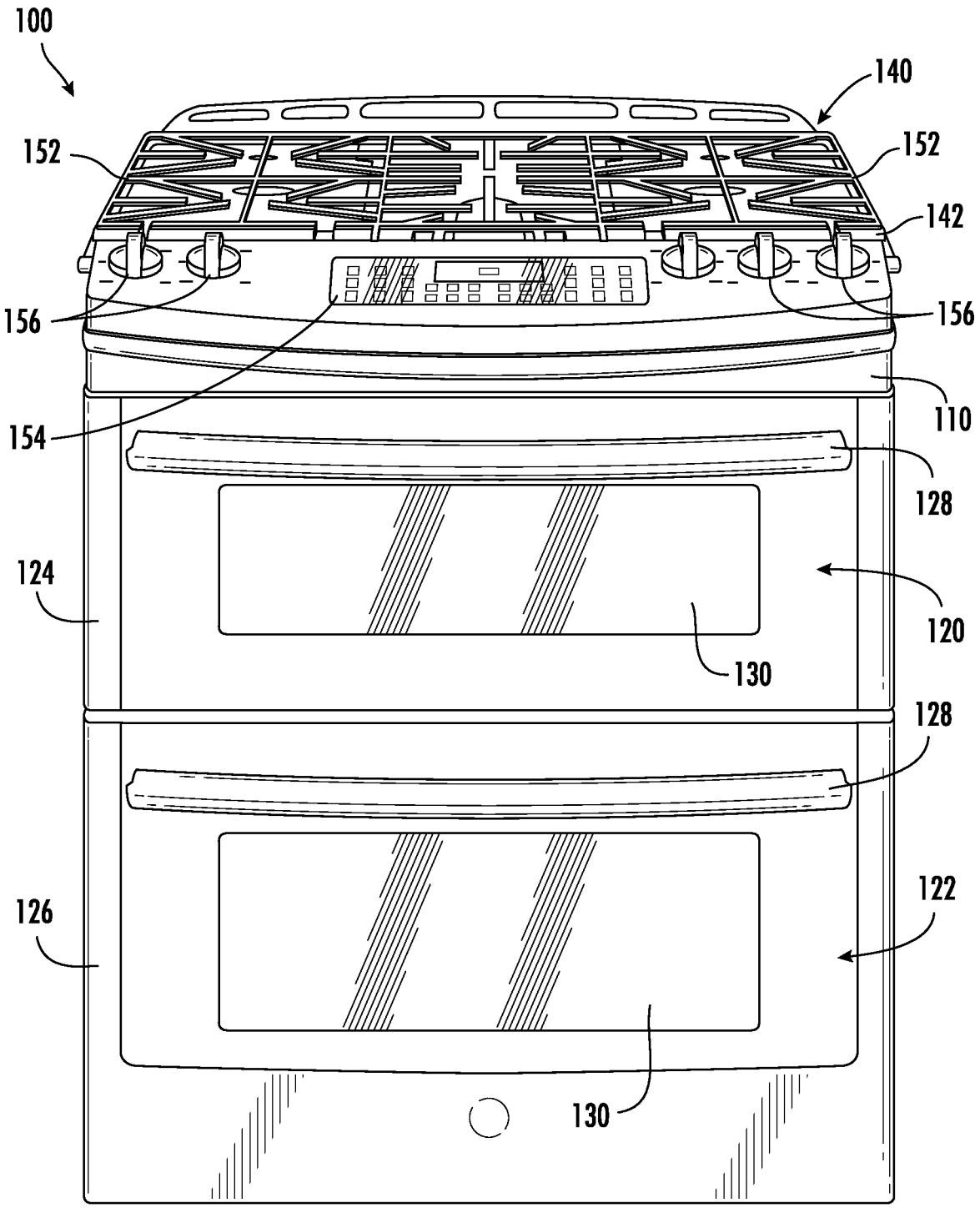
FIG. 1 provides a front, perspective view of a range appliance according to an exemplary embodiment of the present disclosure.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
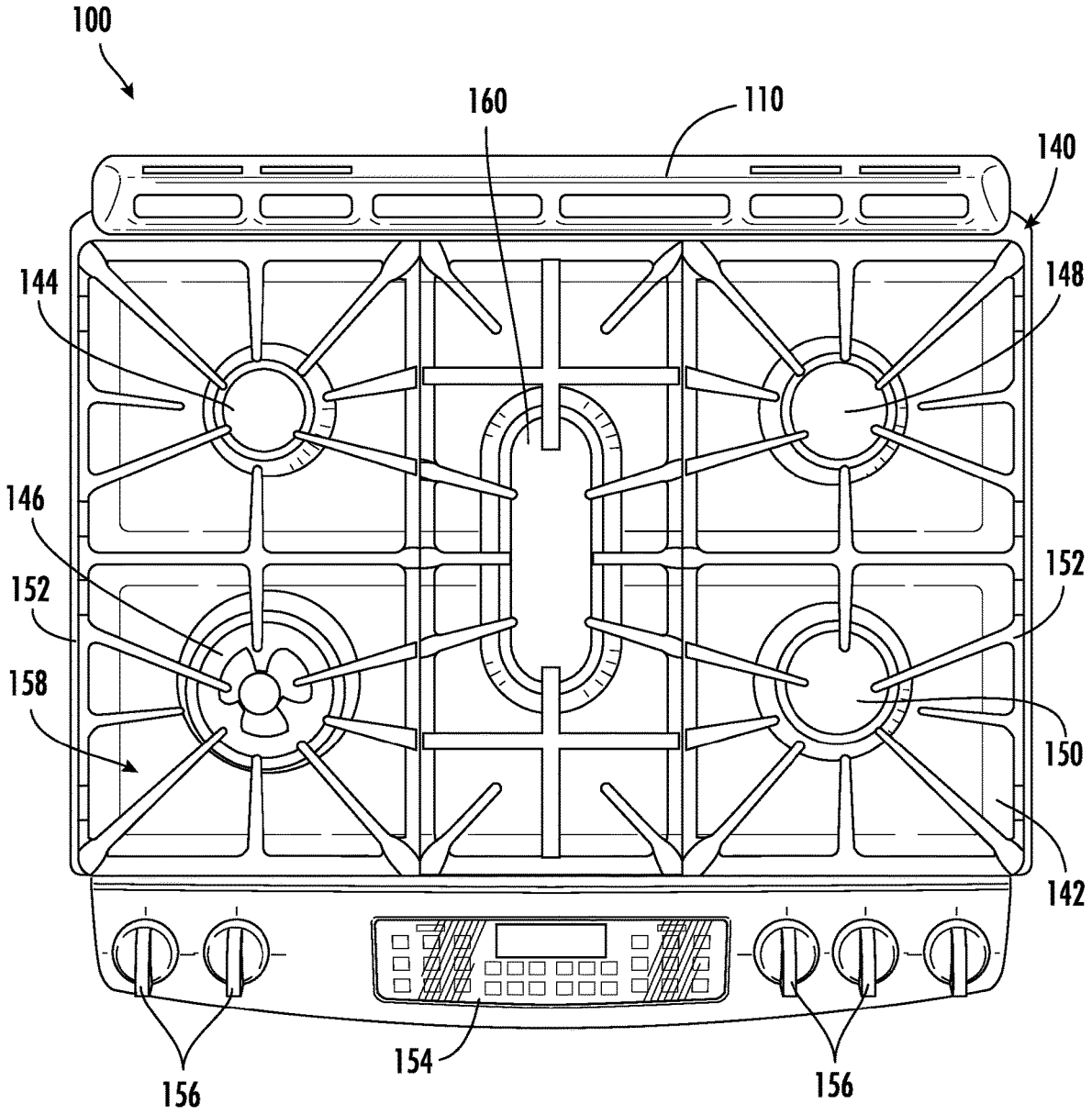
FIG. 2 provides a top, plan view of the exemplary range appliance of FIG. 1.
Figure 3:
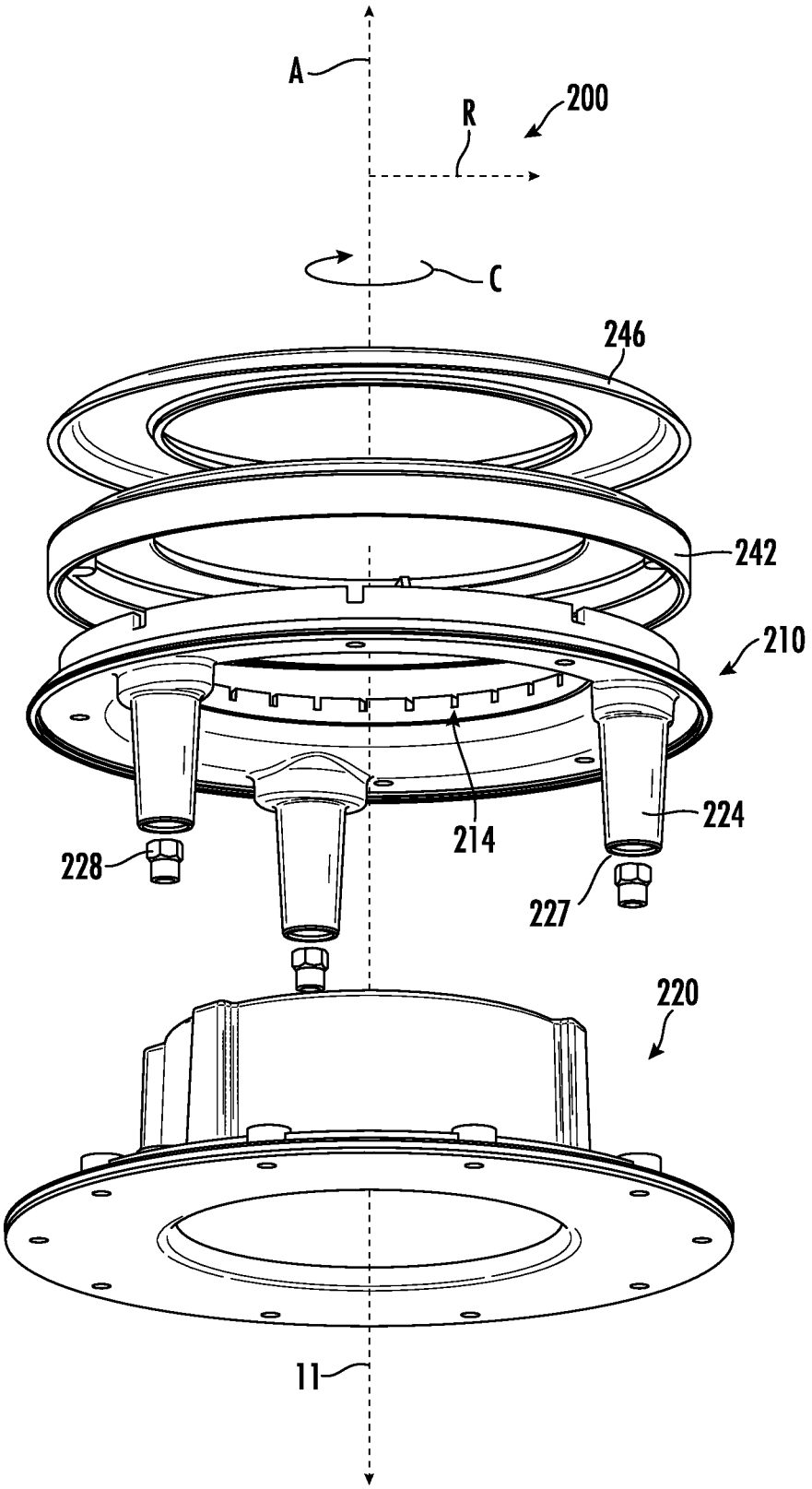
FIG. 3 provides an exploded view of an exemplary burner assembly in accordance with embodiments of the present disclosure.

Turning now to the figures, FIG. 1 provides a front, perspective view of a range appliance 100 as may be employed with the present disclosure. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present disclosure may be used in any suitable appliance (e.g., a single oven range appliance or a standalone cooktop appliance). Thus, the exemplary embodiment shown in FIG. 1 is not intended to limit the present disclosure to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass windowpanes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof. Moreover, top panel 142 may be formed as a unitary, single piece or, alternatively, as multiple discrete pieces joined together.

For range appliance 100, a utensil holding food or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide, for example, for the receipt of cooking utensils (e.g., pots, pans, etc.) of various sizes and configurations and to provide different heat inputs for such cooking utensils. Grates 152 may be supported on a top surface 158 of top panel 142. In optional embodiments, range appliance 100 includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as, for example, whether a particular burner assembly is activated or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Turning now to FIGS. 3-11, various views are provided of a gas burner assembly 200 according to an exemplary embodiment of the present disclosure. As an example, burner assembly 200 may be used in range appliance 100 (FIG. 2) as one of burner assemblies 144, 146, 148, 150. Nonetheless, it will be understood that, while describe in greater detail below in the context of range appliance 100, burner assembly 200 may be used in or with any suitable appliance in alternative exemplary embodiments.

Generally, burner assembly 200 includes an inner burner ring 202. Inner burner ring 202 may be inward firing with a swirling flame pattern. Burner assembly 200 defines an axial direction A, a radial direction R, and a circumferential direction C. A reference centerline axis 11 is depicted extending through the burner assembly 200, from which axial direction A, radial direction R, and circumferential direction C may be extended.

Figure 7:
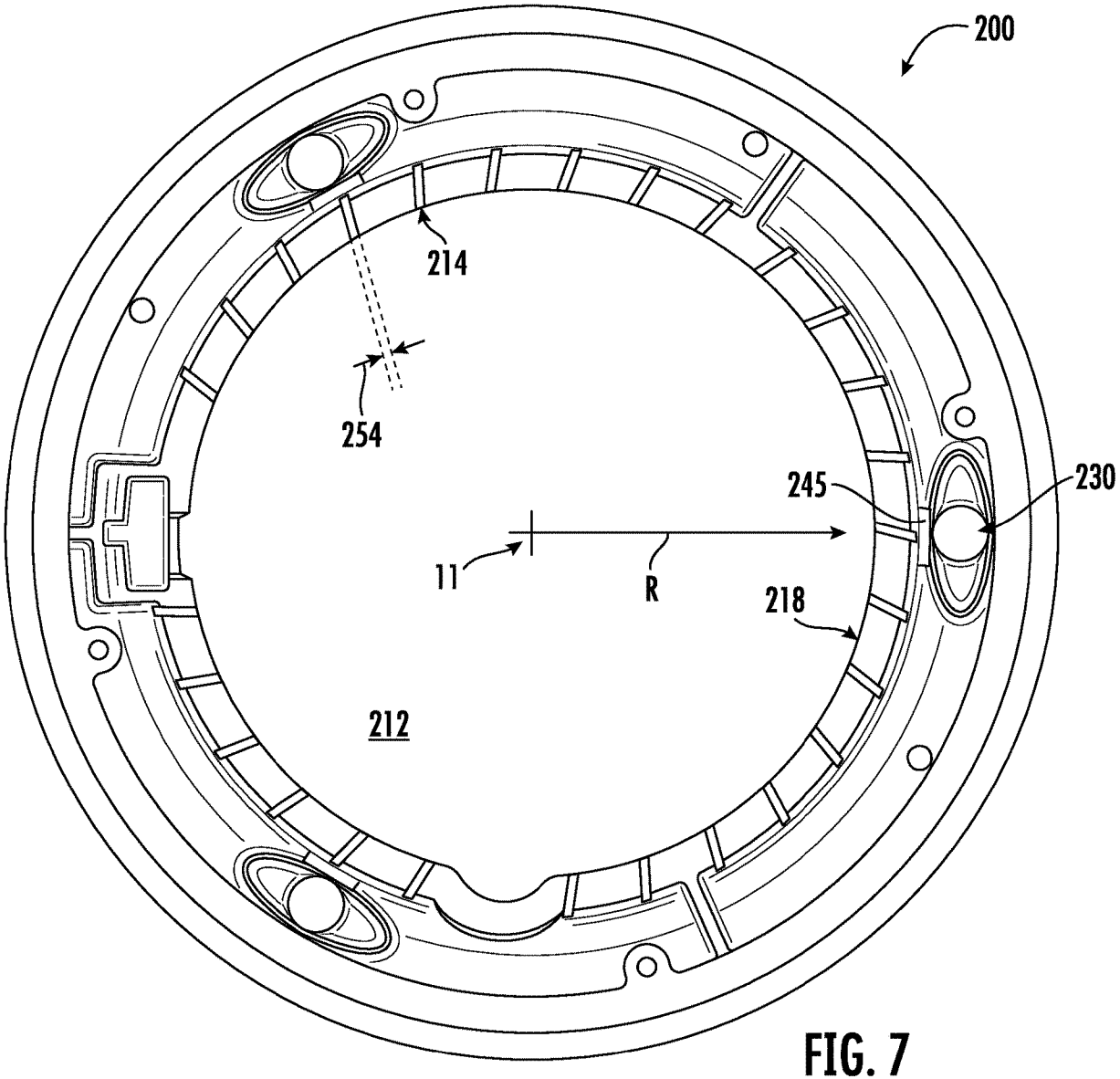
FIG. 7 provides a cutaway plan view of an exemplary burner assembly in accordance with embodiments of the present disclosure.

Burner assembly 200 includes an annular burner body 210. Annular burner body 210 defines a central combustion zone 212 (see, e.g.. FIG. 7). Annular burner body 210 also defines a plurality of flame ports 214 (e.g., at or facing central combustion zone 212). Flame ports 214 may be distributed, for example, along the circumferential direction C, about central combustion zone 212. Gaseous fuel is flowable from a mixing chamber 216 within annular burner body 210 into central combustion zone 212 through flame ports 214. Flame ports 214 may also be oriented such that the gaseous fuel flows in a swirling pattern from flame ports 214 into central combustion zone 212. In certain embodiments, annular burner body 210 includes an inner side wall 218 and an outer side wall 219. Inner side wall 218 may extend around central combustion zone 212 (e.g., along the circumferential direction C). Flame ports 214 may be formed on or extend through inner side wall 218 (e.g., along the radial direction R, between mixing chamber 216 and central combustion zone 212). Outer side wall 219 may extend around inner side wall 218 (e.g., along the circumferential direction C). Outer side wall 219 may also be spaced from inner side wall 218 (e.g., along the radial direction R). Mixing chamber 216 may be defined and positioned between inner and outer side walls 218, 219 (e.g., along the radial direction R, within annular burner body 210). Annular burner body 210 is open at central combustion zone 212. For example, no portion or component of annular burner body 210 may extend (e.g., inward or otherwise along the radial direction R) into central combustion zone 212. In some embodiments, no fuel-providing structure extends into the central combustion zone 212.

Burner assembly 200 also includes a fuel manifold 220. Fuel manifold 220 is positioned beneath burner body 210 (e.g., along axial direction A). Annular burner body 210 is fluidly coupled to fuel manifold 220 upstream from mixing chamber 216 such that the gaseous fuel is flowable from fuel manifold 220 into mixing chamber 216 of annular burner body 210. For example, fuel manifold 220 has an outlet passage 222. The gaseous fuel is flowable from fuel manifold 220 through outlet passage 222 into mixing chamber 216 of annular burner body 210.

As shown, burner body 210 has a vertical Venturi mixing tube 224. Venturi mixing tube 224 has an inlet 227 to a flow passage in fluid communication with the mixing chamber 216. Annular burner body 210 may include a plurality of Venturi mixing tubes 224 positioned at different locations along the circumferential direction C. For instance, the plurality of Venturi mixing tubes 224 may be substantially evenly spaced apart from one another. In various embodiments, the annular burner body includes two or more Venturi mixing tubes 224, such as three Venturi mixing tubes, or other appropriate quantity to provide a fuel-air mixture to mixing chamber 216.

Fuel manifold 220 forms a fuel chamber 229 through which a flow of gaseous fuel is received and provided to the burner body 210. The fuel chamber 229 may include an inlet at any appropriate location and an outlet opening at outlet passage 222. Outlet passage 222 may be positioned at different locations along the circumferential direction C. For instance, a plurality of outlet passages 222 may be substantially evenly spaced apart from one another. In various embodiments, the fuel manifold 220 includes two or more outlet passages 222, such as three outlet passages, or a quantity corresponding to a quantity of vertical Venturi mixing tubes 224, such as to provide a gaseous fuel through the outlet passage 222 to a respective vertical Venturi mixing tube 224.

A fuel nozzle (not shown) may be positioned at and oriented towards an inlet of fuel chamber 229. The fuel nozzle may be connected to a supply line for gaseous fuel, such as propane or natural gas, and the gaseous fuel may flow from the fuel nozzle to the fuel chamber 229.

In various embodiments, the fuel manifold 220 may include at first fuel manifold body 2201 and a second fuel manifold body 2202. Each fuel manifold body 2201, 2202 may form an annular structure including walls spaced apart from one another to form the fuel chamber 229 between the first and second fuel manifold bodies, 2201, 2202. The second fuel manifold body 2202 may mate to one another, such as to form the fuel chamber 229 as a closed plenum having openings to the inlet 226 and outlet 222. For instance, first fuel manifold body 2201 may position atop the second fuel manifold body 2202.

An outlet fuel nozzle 228 may be positioned at the outlet passage 222 at the fuel manifold 220. The outlet fuel nozzle 228 may form a vertical outlet fuel nozzle 228 having a vertically positioned outlet opening 2281. The vertical outlet passage 222 is spaced apart along the axial direction A from the vertical Venturi mixing tube 224. In various embodiments, the outlet passage 222 is positioned at substantially similar locations along the circumferential direction C as the vertical Venturi mixing tube 224.

The gaseous fuel is received through the fuel chamber 229 and pushed out of the chamber 229 through outlet passage 222, or particularly through outlet opening 2281. The gaseous fuel egressing the outlet passage 222, or particularly the outlet fuel nozzle 228, may entrain air from the space between the outlet passage 222 and Venturi inlet 227 at the vertical Venturi mixing tube 224, and the gaseous fuel may mix with the entrained air within vertical Venturi mixing tube 224. The mixture of the gaseous fuel and air may mix at mixing chamber 216 and egress through flame ports 214.

Outlet passages 222 may be distributed or sized to facilitate uniform flow of the gaseous fuel into openings 227. For example, outlet passages 222 may be, for example, uniformly distributed about central combustion zone 212.

In certain embodiments, burner assembly 200 also includes an inlet passage 230. Inlet passages 230 extend downwardly (e.g., along the axial direction A) from the mixing chamber 216 towards fuel manifold 220. Each inlet passage 230 may form an outlet end of a respective Venturi mixing tube 224. Thus, the gaseous fuel-air mixture is flowable from Venturi mixing tube 224 into mixing chamber 216 through inlet passages 230.

In various embodiments, annular burner body 210 is suspended over fuel manifold 220. In particular, vertical Venturi mixing tubes 224 may extend (e.g., along the axial direction A) from annular burner body 210 toward fuel manifold 220 and suspend the annular burner body 210 over the outlet passages 222 at the fuel manifold 220 (e.g., along the axial direction A). With annular burner body 210 suspended over fuel manifold 220, gaseous fuel flowed from the outlet passage 222 at the fuel manifold 220 pulls air from an atmospheric pressure volume formed between the mixing tube inlet 227 and the fuel manifold outlet passage 222.

As shown, annular burner body 210 may include an annular burner base 240 and an annular burner head 242. Annular burner base 240 includes inlet passages 230. Annular burner head 242 may be positioned on annular burner base 240 to form mixing chamber 216 of annular burner body 210. Thus, annular burner base 240 may form a bottom wall of mixing chamber 216, and annular burner head 242 may form a top wall of mixing chamber 216. Annular burner base 240 or annular burner head 242 may be formed of a cast metal, such as cast iron or cast aluminum alloy.

Burner head 242 includes a radial wall 241 extending over the mixing chamber 216. The radial wall 241 extends annularly, such as to form the top wall of mixing chamber 216. An annular outer wall 243 extends from the radial wall 241. The outer wall 243 may extend radially outside of the outer side wall 219. The outer wall 243 may include a surface at which the burner head 242 rests upon the burner base 240

Figure 4:
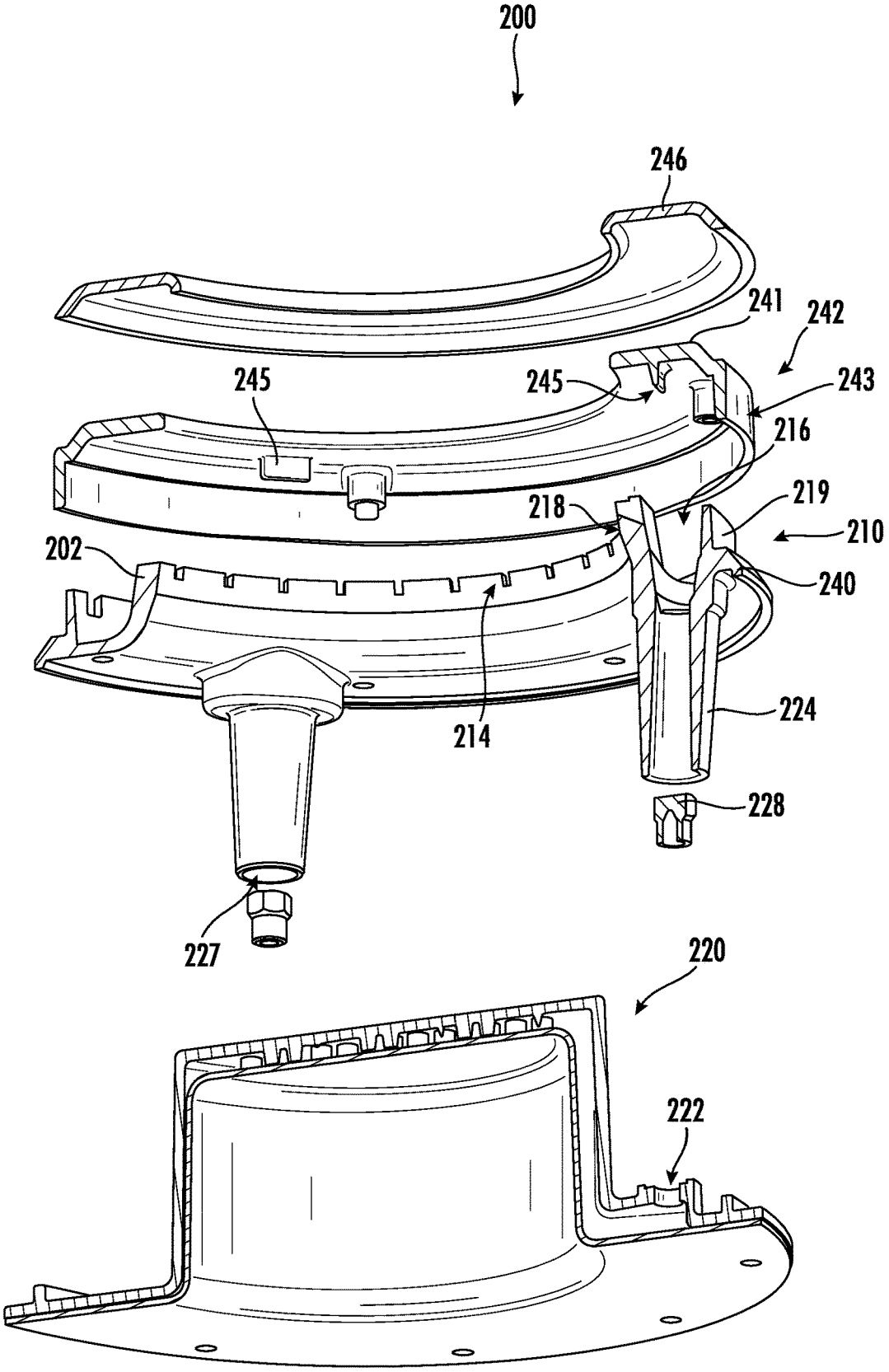
FIG. 4 provides a cutaway perspective exploded view of an exemplary burner assembly in accordance with embodiments of the present disclosure.
Figure 5:
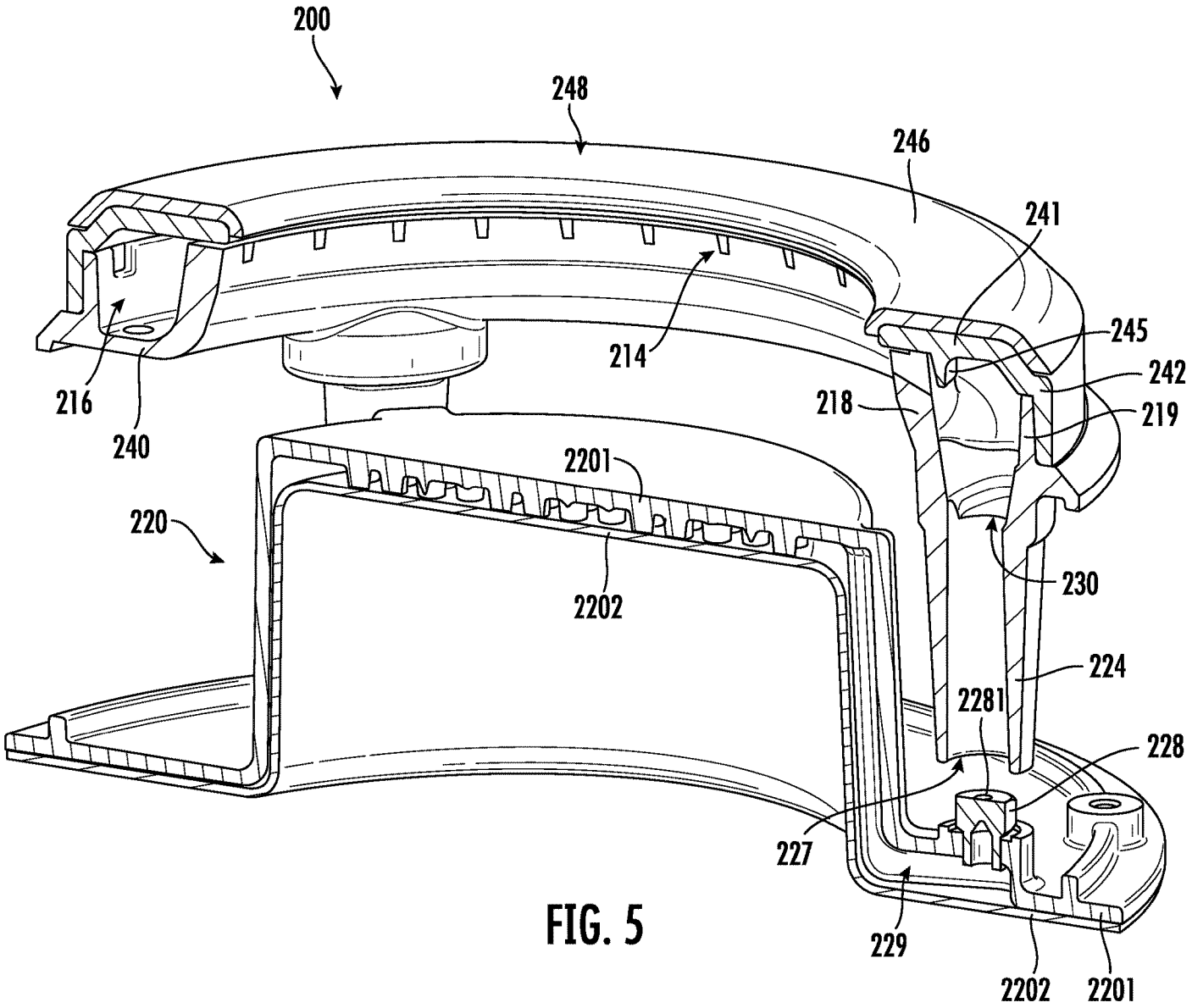
FIG. 5 provides a cutaway perspective view of an exemplary burner assembly in accordance with embodiments of the present disclosure.
Figure 6:
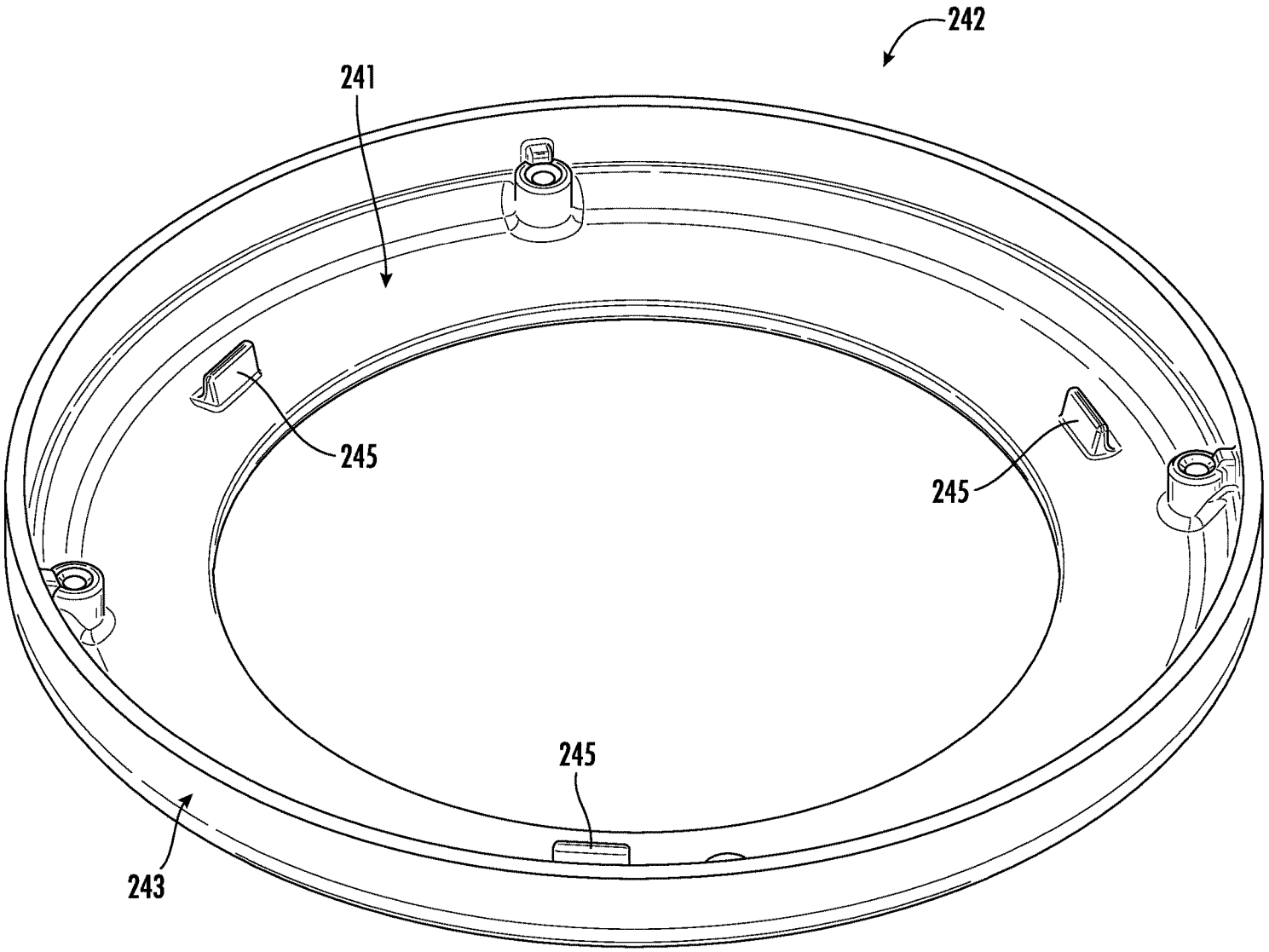
FIG. 6 provides a perspective view of an exemplary burner head of the burner assembly in accordance with embodiments of the present disclosure.

A tab 245 extends from the radial wall 241 into the mixing chamber 216, such as along the axial direction A when the burner head 242 is positioned atop the burner body 210. In various embodiments, such as depicted in FIGS. 4-5, the tab 245 extends downward along the axial direction A from a bottom surface of the radial wall 241, such as toward the fuel manifold 220 when the burner head 242 is positioned atop the burner body 210. The tab 245 extends for a length L from the radial wall 241 into the mixing chamber 216. In various embodiments, the length L of the tab 245 is approximately equal to or greater than a height H of an outlet opening 2141 of the flame port 214. In some embodiments, a distal end 2451 of the tab 245 from the radial wall 241 extends along axial direction A approximately equal to or greater than height H of outlet opening 2141 of the flame port 214. For instance, distal end 2451 may extend from the radial wall 241 lower along axial direction A than an extension of the outlet opening 2141 along axial direction A.

In still various embodiments, the tab 245 is positioned proximate along the radial direction R to the inner side wall 218. For instance, the tab 245 is positioned in the mixing chamber 216 more proximate along the radial direction R to the inner side wall 218 than the outer side wall 219. The tab 245 may extend along an arc along the circumferential direction C or may extend substantially at a chord relative to the circumferential direction C.

The burner head 242 may include a plurality of tabs 245. In various embodiments, the burner head 242 includes a quantity of tabs 245 corresponding to a quantity of fuel inlet passages 230. For instance, the burner head 242 may include a respective tab 245 for each fuel inlet passage 230. Accordingly, the plurality of tabs 245 may be disjointed from one another along the circumferential direction C.

Figure 8:
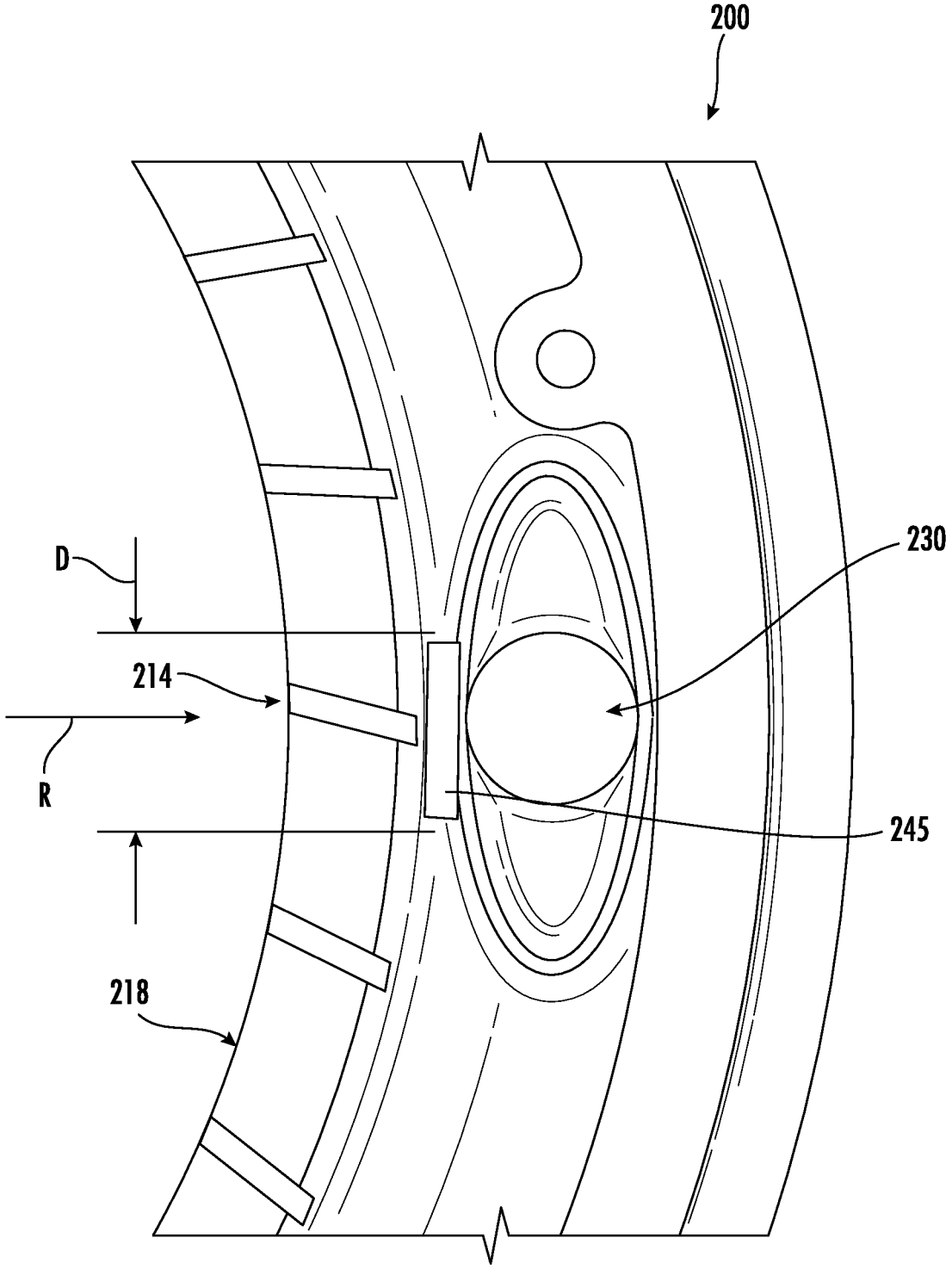
FIG. 8 provides a detailed view of a portion of the exemplary burner assembly of FIG. 7 in accordance with embodiments of the present disclosure.

In various embodiments, such as depicted in FIG. 8, the tab 245 extends along a dimension D corresponding to a dimension of the inlet passage 230, such as a diameter or width of the inlet passage 230. For instance, the width of the inlet passage 230 may correspond to a dimension extending along the circumferential direction C. Tab 245 may extend along dimension D approximately equal to or less than the dimension (e.g., diameter or width) of the inlet passage 230.

Figure 9:
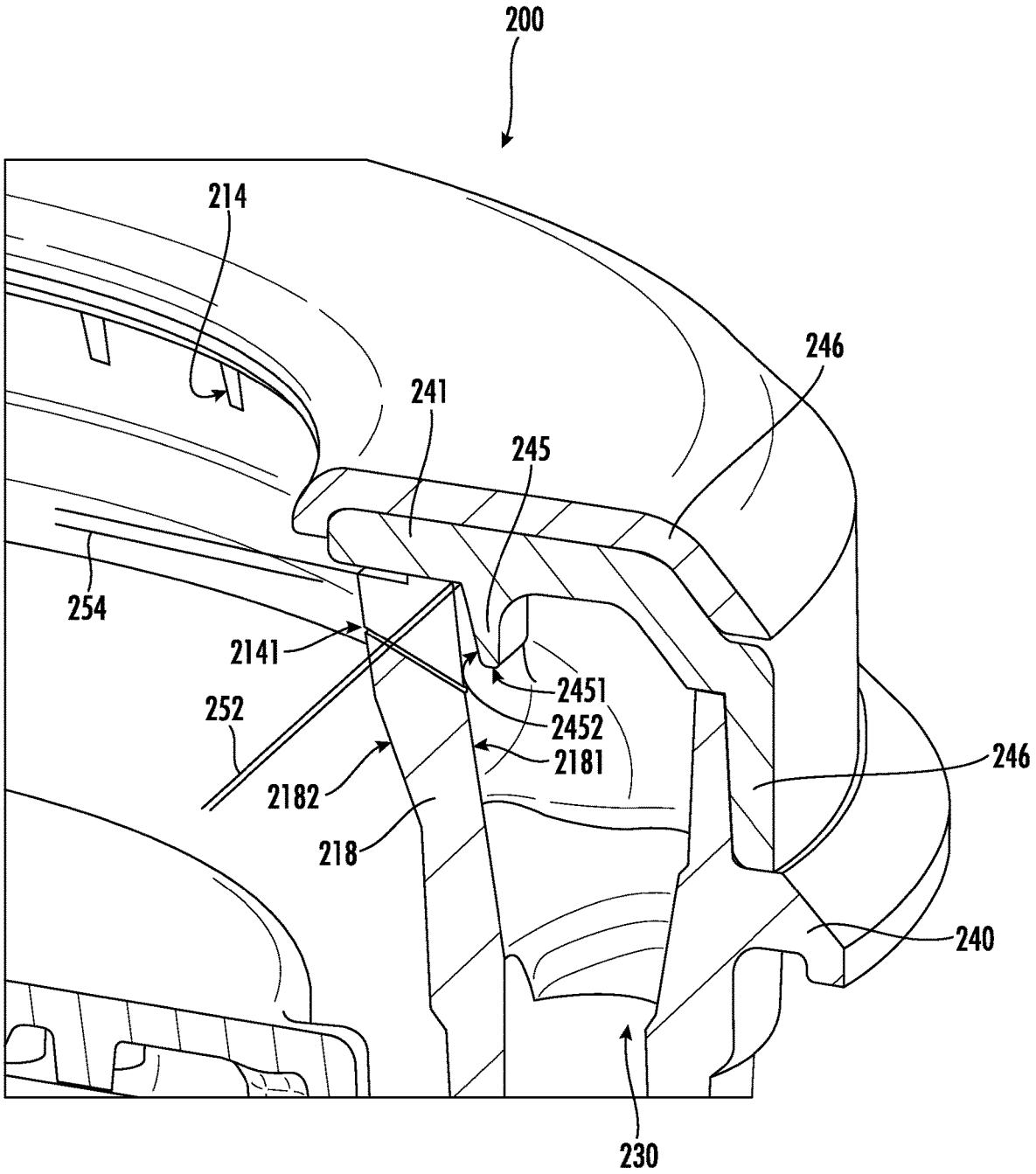
FIG. 9 provides a detailed cutaway perspective view of a portion of an exemplary burner assembly in accordance with embodiments of the present disclosure.

Referring still to FIG. 8, and further referring to FIG. 9, in various embodiments, the tab 245 and at least one flame port 214 are radially co-positioned to one another. For instance, the tab 245 and at least one flame port 214 are co-positioned along radial direction R extending from centerline axis 11.

In various embodiments, burner assembly 200 includes a gap 252 between an inside face 2181 of inner side wall 218 in the mixing chamber 216 and an inner face 2452 of the tab 245. For instance, the tab 245 is spaced apart along the radial direction R from the inside face 2181 of the inner side wall 218. In some embodiments, a dimension of the gap 252 is equal to or less than a width 254 of the flame port 214. In still some embodiments, the width 254 is a maximum width of the flame port 214. For example, the flame port may include a variable width, and width 254 may be the maximum width of the flame port. In still some embodiments, the width 254 is relative to the outlet opening 2141 of the flame port 214.

Figure 10:
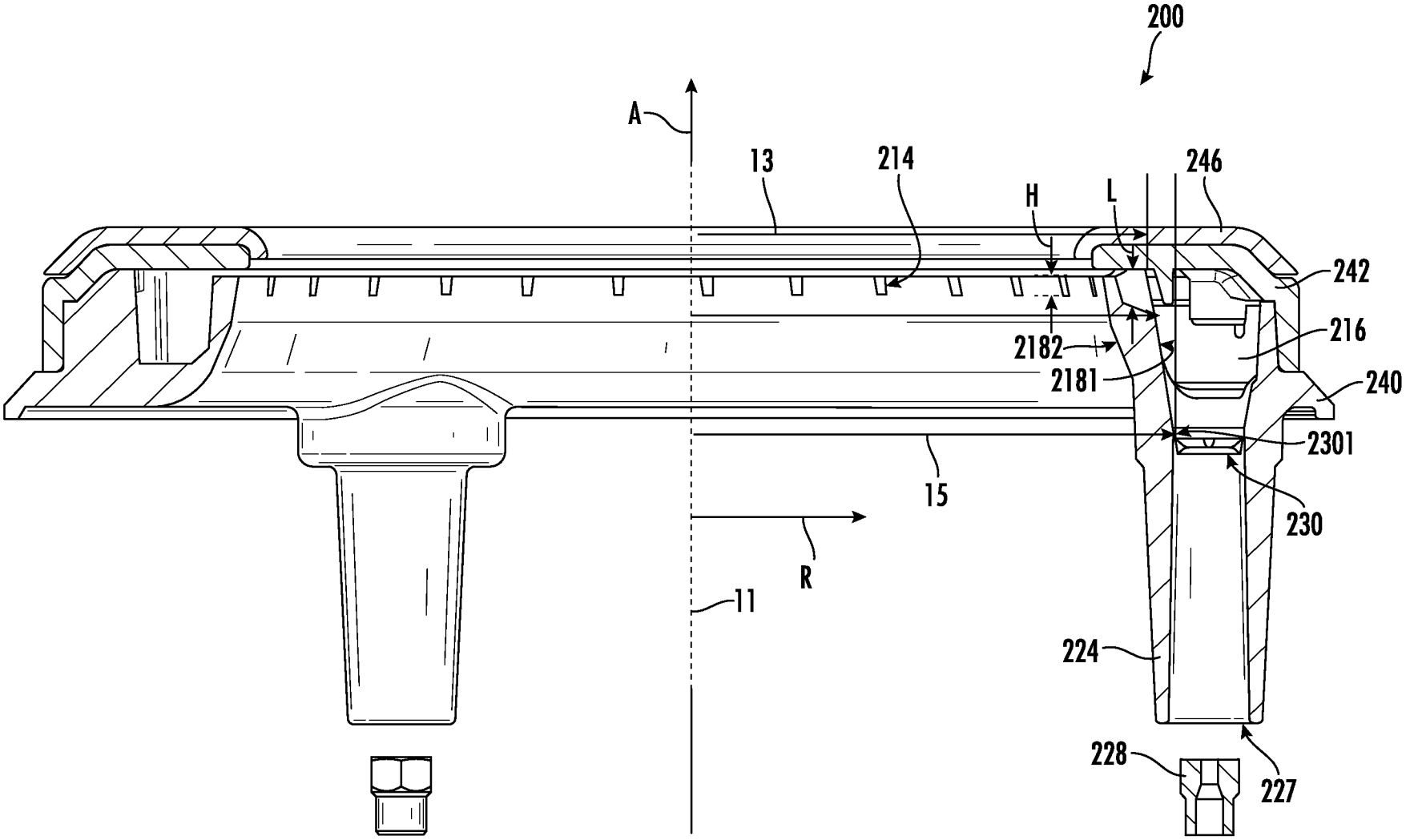
FIG. 10 provides a cutaway side view of an exemplary burner assembly in accordance with embodiments of the present disclosure.

Referring to FIG. 10, in still some embodiments, the tab 245 is radially positioned between the inside face 2181 and an inner wall 2301 of the inlet passage 230. The inlet passage 230 may form a Venturi throat structure. The inner wall 2301 may particularly include an inside-most point or chord (relative centerline axis 11 along radial direction R) of a round or substantially round inner wall of the inlet passage 230. In some embodiments, the inside face 2181 of the inner side wall 218 is angled (e.g., oblique to the centerline axis 11). The tab 245 may be positioned between an innermost portion of the inside face 2181 (such as depicted relative to radial position 13) and the inner wall 2301 of the inlet passage 230 (such as depicted relative to radial position 15). In still various embodiments, distal end 2451 of tab 245 is positioned between radial positions 13, 15.

In some embodiments, annular burner body 210 may also include an annular burner cap 246. For instance, annular burner cap 246 may be positioned on annular burner head 242 such that annular burner cap 246 covers annular burner head 242. Annular burner cap 246 may reduce staining of annular burner base 240 or annular burner head 242. For example, annular burner cap 246 may include an enamel coating on an outer surface 248 of annular burner cap 246. For example, the enamel coating may face away from annular burner head 242 and be visible to a user of burner assembly 200 when burner assembly 200 is positioned on top panel 142. The enamel coating on annular burner cap 246 may be easier to clean than and less stainable by spills from cooking utensils than the cast metal of annular burner base 240 or annular burner head 242.

Figure 11:
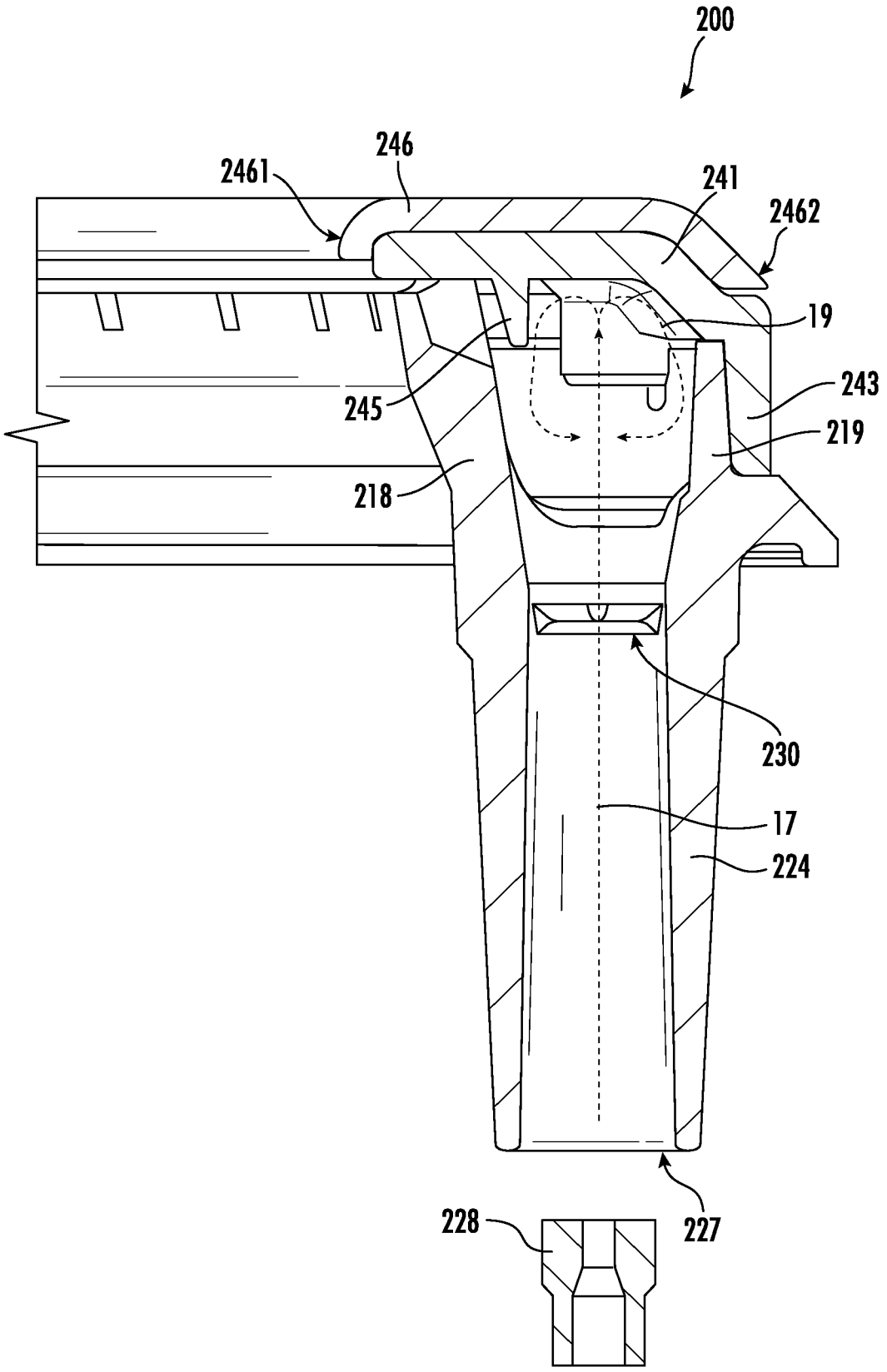
FIG. 11 provides a detailed cutaway side view of a portion of the exemplary burner assembly of FIG. 10 in accordance with embodiments of the present disclosure.

Referring to FIG. 11, annular burner cap 246 includes an inner diameter 2461 and an outer diameter 2462. Radial wall 241 at burner head 242 may extend within the inner and outer diameters 2461, 2462. Inner side wall 218 and outer side wall 219 may be positioned substantially within the inner and outer diameters 2461, 2462, or furthermore, inside surfaces at the mixing chamber 216 may extend substantially within diameters 2461, 2462, or furthermore, within radial wall 241. Embodiments of the burner assembly 200 depicted and described herein allow for maintaining inner and outer diameter 2461, 2462 at advantageous ranges, separately or relative to one another (e.g., maintaining a desired thickness or difference between diameters 2461, 2462), such as based on configuration of appliance 100, burner power, or aesthetic appearance, such as to allow for positioning embodiments of tab 245 without requiring alterations to inner diameter 2461, outer diameter 2462, or both.

Referring still to FIG. 11, an exemplary operation of the burner assembly 200 includes receiving a flow of gaseous fuel, depicted schematically via arrows 17, from the fuel manifold 220, such as through outlet fuel nozzle 228, and into the mixing tube 224 through inlet 227. Embodiments of the burner assembly 200 may allow for an indirect flow of fuel from the mixing tube and through an adjacent flame port. The burner assembly 200 including embodiments of tab 245 such as depicted and described herein may block a direct velocity head to the flame port 214 by re-directing the flow of fuel to static pressure, such as depicted schematically via arrows 19. The flow of fuel 17 from the mixing tube 224 may impinge the radial wall 241 of the burner head 242 (e.g., an inner surface of the radial wall 241 at the mixing chamber 216). The impinged flow of fuel 19 may reside along a thin boundary layer at the inner surface of the radial wall 241. Tab 245 such as depicted and described herein may prevent a velocity head proximate to flame ports 214 positioned more proximate to the inlet passage 230 (e.g., flame ports radially co-positioned with the tab).

Embodiments of tab 245 positioned outside of a diameter of the inlet passage 230 (e.g., outside a Venturi diameter), such as between radial positions 13, 15 described herein, may mitigate efficiency losses, functional restrictions, or reductions in air entrainment to the Venturi mixing tube, while further blocking a direct velocity head to the flame port 214, such as described above.

Embodiments of burner assembly 200 including tab 245 such as described herein may allow for substantially equal flame lengths at flame ports adjacent to the inlet passage as flame ports distal to the inlet passage. Such benefits may be allowed across an entire, or substantially entire, operating range of the burner assembly. Embodiments such as provided herein may allow for positioning the tab within a mixing chamber without forming partitions, volumes, or dividers to the mixing chamber that may otherwise affect fuel distribution, flame length, manufacturability, or burner assembly diameter. Advantageously, embodiments provided herein may provide one or more benefits described herein without requiring alterations in burner assembly diameter (e.g., increasing inner diameter, increasing thickness or range from inner diameter to outer diameter, or increasing outer diameter) that may result in undesired changes in burner power, heat distribution, or aesthetic appearance. Accordingly, embodiments of the burner assembly 200 provided herein allow for one or more benefits and advantages described herein while furthermore maintaining desired functional and aesthetic aspects.

Further aspects of the disclosure are provided in the following clauses:

1. A cooktop appliance, including a gas burner assembly positioned at a top panel, the gas burner assembly including an annular burner body positioned at a top surface of the top panel, the annular burner body forming a central combustion zone, a plurality of flame ports at the central combustion zone, and an annular mixing chamber upstream from the plurality of flame ports to permit a fuel-air mixture to flow into the central combustion zone through the plurality of flame ports, the annular burner body being open at the central combustion zone such that a circumferentially bounded portion of the top panel is vertically exposed through the annular burner body at the central combustion zone, the gas burner assembly including and annular burner head forming a top wall of the mixing chamber, the burner head including a tab extending along an axial direction into the mixing chamber, the tab radially co-positioned to at least one flame port and an inlet passage forming a fluid communication from a mixing tube to the mixing chamber, wherein the mixing tube and inlet passage are configured to receive a flow of gaseous fuel and provide the gaseous fuel to the mixing chamber.
2. The cooktop appliance of any one or more clauses herein, wherein the tab extends for a length into the mixing chamber approximately equal to or greater than a height of an outlet opening of the flame port.
3. The cooktop appliance of any one or more clauses herein, wherein a gap is formed between the tab and an inner side wall of the burner body.
4. The cooktop appliance of any one or more clauses herein, wherein the tab is positioned proximate along a radial direction to an inner side wall of the burner body relative to an outer side wall of the burner body.
5. The cooktop appliance of any one or more clauses herein, wherein the tab extends along an arc or chord relative to a circumferential direction from a centerline axis of the burner assembly.
6. The cooktop appliance of any one or more clauses herein, wherein the tab extends along the arc or chord approximately equal to or less than a width of the inlet passage.
7. The cooktop appliance of any one or more clauses herein, wherein the tab is positioned along a radial direction between an inside face of an inner side wall of the burner body and an inner wall of the inlet passage.
8. The cooktop appliance of any one or more clauses herein, wherein the inner wall of the inlet passage is a Venturi throat structure.
9. The cooktop appliance of any one or more clauses herein, wherein the mixing tube is a vertically extended Venturi mixing tube.
10. The cooktop appliance of any one or more clauses herein, wherein the tab includes a distal end extending into the mixing chamber, and wherein the distal end of the tab extends lower along the axial direction than an extension of an outlet opening of the flame port.
11. The cooktop appliance of any one or more clauses herein, the burner body including a plurality of vertical mixing tubes each including a respective inlet passage, wherein the plurality of vertical mixing tubes is substantially equally spaced apart from one another along a circumferential direction, and wherein the burner head includes a plurality of tabs each radially co-positioned to a respective flame port and respective inlet passage of each vertical mixing tube.
12. A gas burner assembly for a cooktop appliance, the gas burner assembly including an annular burner body forming a central combustion zone, wherein the burner body forms a plurality of flame ports at the central combustion zone, the burner body being open at the central combustion zone; an annular burner head placeable onto the burner body to form a top wall of an annular mixing chamber upstream from the plurality of flame ports, a mixing tube extending along an axial direction, the mixing tube including an inlet passage extending along the axial direction in fluid communication with the mixing chamber, the mixing tube configured to provide a flow of gaseous fuel to the mixing chamber, wherein the burner head includes a tab extending along the axial direction into the mixing chamber, the tab radially co-positioned to at least one flame port and the inlet passage.
13. The gas burner assembly of any one or more clauses herein, wherein the tab extends for a length into the mixing chamber approximately equal to or greater than a height of an outlet opening of the flame port.
14. The gas burner assembly of any one or more clauses herein, wherein a gap is formed between the tab and an inner side wall of the burner body.
15. The gas burner assembly of any one or more clauses herein, wherein the tab is positioned proximate along a radial direction to an inner side wall of the burner body relative to an outer side wall of the burner body.
16. The gas burner assembly of any one or more clauses herein, wherein the tab extends along an arc or chord relative to a circumferential direction from a centerline axis of the burner assembly.
17. The gas burner assembly of any one or more clauses herein, wherein the tab extends along the arc or chord approximately equal to or less than a width of the inlet passage.
18. The gas burner assembly of any one or more clauses herein, wherein the tab is positioned along a radial direction between an inside face of an inner side wall of the burner body and an inner wall of the inlet passage.
19. The gas burner assembly of any one or more clauses herein, wherein the inner wall of the inlet passage is a Venturi throat structure.
20. The gas burner assembly of any one or more clauses herein, the burner body including a plurality of vertical mixing tubes each including a respective inlet passage, wherein the plurality of vertical mixing tubes is substantially equally spaced apart from one another along a circumferential direction, and wherein the burner head includes a plurality of tabs each radially co-positioned to a respective flame port and respective inlet passage of each vertical mixing tube.

21. A cooktop appliance including the burner assembly of any one or more clauses herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a gas burner assembly positioned at a top panel, the gas burner assembly comprising an annular burner body positioned at a top surface of the top panel, the annular burner body forming a central combustion zone, a plurality of flame ports at the central combustion zone, and an annular mixing chamber upstream from the plurality of flame ports to permit a fuel-air mixture to flow into the central combustion zone through the plurality of flame ports, the annular burner body being open at the central combustion zone such that a circumferentially bounded portion of the top panel is vertically exposed through the annular burner body at the central combustion zone, the gas burner assembly comprising an annular burner head forming a top wall of the mixing chamber, the burner head comprising a tab extending along an axial direction into the mixing chamber, the tab radially co-positioned to at least one flame port and an inlet passage forming a fluid communication from a mixing tube to the mixing chamber, wherein the tab extends along an arc or chord relative to a circumferential direction from a centerline axis of the burner assembly, wherein the tab extends along the arc or chord approximately equal to or less than a width of the inlet passage, and wherein the mixing tube and inlet passage are configured to receive a flow of gaseous fuel and provide the gaseous fuel to the mixing chamber.

2. The cooktop appliance of claim 1, wherein the tab extends for a length into the mixing chamber approximately equal to or greater than a height of an outlet opening of the flame port.

3. The cooktop appliance of claim 1, wherein a gap is formed between the tab and an inner side wall of the burner body.

4. The cooktop appliance of claim 1, wherein the tab is positioned proximate along a radial direction to an inner side wall of the burner body relative to an outer side wall of the burner body.

5. The cooktop appliance of claim 1, wherein the tab is positioned along a radial direction between an inside face of an inner side wall of the burner body and an inner wall of the inlet passage.

6. The cooktop appliance of claim 5, wherein the inner wall of the inlet passage is a Venturi throat structure.

7. The cooktop appliance of claim 1, wherein the mixing tube is a vertically extended Venturi mixing tube.

8. The cooktop appliance of claim 1, wherein the tab comprises a distal end extending into the mixing chamber, and wherein the distal end of the tab extends lower along the axial direction than an extension of an outlet opening of the flame port.

9. The cooktop appliance of claim 1, the burner body comprising a plurality of vertical mixing tubes each comprising a respective inlet passage, wherein the plurality of vertical mixing tubes is substantially equally spaced apart from one another along a circumferential direction, and wherein the burner head comprises a plurality of tabs each radially co-positioned to a respective flame port and respective inlet passage of each vertical mixing tube.

10. A gas burner assembly for a cooktop appliance, the gas burner assembly comprising:

an annular burner body forming a central combustion zone, wherein the burner body forms a plurality of flame ports at the central combustion zone, the burner body being open at the central combustion zone;

an annular burner head placeable onto the burner body to form a top wall of an annular mixing chamber upstream from the plurality of flame ports, a mixing tube extending along an axial direction, the mixing tube comprising an inlet passage extending along the axial direction in fluid communication with the mixing chamber, the mixing tube configured to provide a flow of gaseous fuel to the mixing chamber, wherein the burner head comprises a tab extending along the axial direction into the mixing chamber, the tab radially co-positioned to at least one flame port and the inlet passage, wherein the tab extends along an arc or chord relative to a circumferential direction from a centerline axis of the burner assembly, wherein the tab extends along the arc or chord approximately equal to or less than a width of the inlet passage.

11. The gas burner assembly of claim 10, wherein the tab extends for a length into the mixing chamber approximately equal to or greater than a height of an outlet opening of the flame port.

12. The gas burner assembly of claim 10, wherein a gap is formed between the tab and an inner side wall of the burner body.

13. The gas burner assembly of claim 10, wherein the tab is positioned proximate along a radial direction to an inner side wall of the burner body relative to an outer side wall of the burner body.

14. The gas burner assembly of claim 10, wherein the tab is positioned along a radial direction between an inside face of an inner side wall of the burner body and an inner wall of the inlet passage.

15. The gas burner assembly of claim 14, wherein the inner wall of the inlet passage is a Venturi throat structure.

16. The gas burner assembly of claim 10, the burner body comprising a plurality of vertical mixing tubes each comprising a respective inlet passage, wherein the plurality of vertical mixing tubes is substantially equally spaced apart from one another along a circumferential direction, and wherein the burner head comprises a plurality of tabs each radially co-positioned to a respective flame port and respective inlet passage of each vertical mixing tube.

* * * * *